US007556727B2

(12) United States Patent
Shibuya et al.

(10) Patent No.: US 7,556,727 B2
(45) Date of Patent: Jul. 7, 2009

(54) KEROSENE COMPOSITION

(75) Inventors: Masahiko Shibuya, Tokyo (JP); Tsutomu Yoshida, Tokyo (JP); Yasuyuki Komatsu, Tokyo (JP); Noe Takehira, Tokyo (JP)

(73) Assignee: Shell Oil Company, Houston, TX (US)

( * ) Notice: Subject to any disclaimer, the term of this patent is extended or adjusted under 35 U.S.C. 154(b) by 355 days.

(21) Appl. No.: 11/015,549

(22) Filed: Dec. 17, 2004

(65) Prior Publication Data

US 2005/0145539 A1 Jul. 7, 2005

(30) Foreign Application Priority Data

Dec. 19, 2003 (JP) ..... 2003-423366

(51) Int. Cl.
*C10L 1/04* (2006.01)
*C10L 1/16* (2006.01)

(52) U.S. Cl. ..... 208/15; 585/14

(58) Field of Classification Search ..... 585/14; 208/15

See application file for complete search history.

(56) References Cited

U.S. PATENT DOCUMENTS 3,620,961 A * 11/1971 Ireland et al. ..... 208/79
3,640,691 A * 2/1972 Ilnyckyj et al. ..... 44/393
3,955,940 A * 5/1976 Hollyday, Jr. ..... 44/394
3,985,638 A * 10/1976 Kirk, Jr. ..... 208/15
4,125,566 A * 11/1978 Trin Dinh et al. ..... 208/65
5,689,031 A * 11/1997 Berlowitz et al. ..... 585/734
5,766,274 A * 6/1998 Wittenbrink et al. ..... 44/436
5,807,413 A * 9/1998 Wittenbrink et al. ..... 44/451
5,833,839 A * 11/1998 Wittenbrink et al. ..... 208/112
6,669,743 B2 * 12/2003 Wittenbrink et al. ..... 44/436
2002/0128332 A1 * 9/2002 O'Rear et al. ..... 518/728
2004/0149627 A1 8/2004 Koide et al.

FOREIGN PATENT DOCUMENTS

JP 63150380 A * 6/1988
JP 3-182594 8/1991
WO WO 05/059062 A1 6/2005

OTHER PUBLICATIONS

Ariyoshi, et al.; English Translation of Table 1 in JP-63150380, Jun. 23, 1988 [1 page].
Ariyoshi, et al.; English Translation of Table 2 in JP-63150380, Jun. 23, 1988 [1 page].

* cited by examiner

*Primary Examiner*—Walter D Griffin
*Assistant Examiner*—Huy-Tram Nguyen

(57) ABSTRACT

A kerosene composition is provided containing, in relation to the total composition, at least 99% by weight of n-paraffins and iso-paraffins, having the properties indicated by the following formulae:

$$6.0° \text{ C.} \leqq FBP(\text{end point}) - 95\% \text{ distillation point} \leqq 11.0° \text{ C.}; \quad (A)$$

$$240° \text{ C.} \leqq \text{FBP} \leqq 270° \text{ C.}; \quad (B)$$

$$150° \text{ C.} \leqq \text{IBP(initial distillation point)} \leqq 165° \text{ C.} \quad (C)$$

19 Claims, No Drawings

KEROSENE COMPOSITION

FIELD OF THE INVENTION

The present invention relates to kerosene compositions, particularly for heating purposes.

BACKGROUND OR THE INVENTION

Kerosene is widely used for heating purposes and cooking purposes. When conventional kerosene is used for heating purposes there is an oily smell when the kerosene is being handled when supplying the oil, for example, and the user is subjected to an unpleasant sensation. Furthermore, incomplete combustion occurs on ignition and on extinguishing when this type of kerosene is used in an open-type stove such as a portable stove or a fan heater or when it is used in a small portable cooking stove in the kitchen, and there is a problem in that there is an unpleasant smell due to the unburned hydrocarbons which are produced at this time.

On the other hand, the demand for higher levels of safety and comfort (the production of smaller amounts of NOx, hydrocarbon compounds, CO, SO2, etc. and no accompanying unpleasant smell) by the user in connection with oil stoves has increased year by year. Furthermore, in recent years kerosene which has been stored through the summer has been recirculated and problems also arise in that oil stoves break down as a result of using such kerosene. There is thus also a demand for improvement of the storage stability of kerosene. In view of such a situation, the kerosene which is being used in oil stoves must respond satisfactorily to these user demands.

A method in which a kerosene vaporization catalyst is used, described in JP-B-59-16814, a method in which a deodorising agent is added to the kerosene, described in JP-B-54-32003, and a kerosene comprising n-paraffins and iso-paraffins, described in JP-A-63-150380, for example, have been suggested as methods for overcoming the generally observed problems of the unpleasant sensation when handling kerosene and the unpleasant smell when kerosene is being ignited or extinguished.

However, with the method in which a kerosene vaporization catalyst is used, the catalyst deteriorates with the passage of time and so it has been difficult to maintain clean combustion over a prolonged period of time. Furthermore, the method in which a deodorizing agent is added to kerosene is not very effective because of the problem that the smell is not agreeable to some people. Furthermore, although kerosenes containing n-paraffins and iso-paraffins do not have an unpleasant smell when they are being handled, when they are ignited or when they are extinguished, and the exhaust gas is also clean, the production costs are greatly increased and there is a problem in that kerosene of this type is inevitably expensive. Furthermore, kerosenes containing iso-paraffins and n-paraffins which have 9 or 10 carbon atoms as the main component have a lower density than existing kerosenes and the fuel consumption by volume is increased, and so, for example, there is a risk that the JIS specification (of the Japanese Standards Association) for the indicated fuel consumption of an oil stove will not be satisfied. Moreover, the flash point is reduced and there are problems with safety in respect, for example, of the extinguishing time.

SUMMARY OF THE INVENTION

A kerosene composition is provided comprising, in relation to the total composition, at least 99% by weight of n-paraffins and iso-paraffins, having the properties indicated by the following formulae:

$$6.0^\circ\ \text{C.} \leqq FBP(\text{end point}) - 95\%\ \text{distillation point} \leqq 11.0^\circ\ \text{C.} \quad \text{(A)}$$

$$240^\circ\ \text{C.} \leqq \text{FBP} \leqq 270^\circ\ \text{C.} \quad \text{(B)}$$

$$150^\circ\ \text{C.} \leqq \text{IBP(initial distillation point)} \leqq 165^\circ\ \text{C.} \quad \text{(C)}$$

DETAILED DESCRIPTION OF THE INVENTION

The present invention provides kerosene compositions of which the extinguishing time and the amount of heat generated [hereinafter, the amount of heat generated or the heating performance, in the absence of any indication to the contrary, signifies the amount of heat generated with respect to time (J/h)] are about the same as those of kerosenes in general, with which the kerosene itself has very little smell and has no unpleasant smell when it is being handled, with which there is no smell when the kerosene is ignited and when it is extinguished, which has good combustion properties, with which the exhaust gas on burning is clean, and which has excellent storage stability, a short extinguishing time and excellent heating performance, features which have not been obtained with the conventional methods.

It has been found that the aforementioned advantages can be realized with a kerosene which has n-paraffins and iso-paraffins as the main components, which has certain distillation properties and which has a specified composition instead of conventional kerosene which has been obtained by the distillation of crude oil.

According to the present invention there is provided a kerosene composition comprising, in relation to the total composition, at least 99% by weight of n-paraffins and iso-paraffins, which composition has the properties indicated by the following formulae:

$$6.0^\circ\ \text{C.} \leqq FBP(\text{end point}) - 95\%\ \text{distillation point} \leqq 11.0^\circ\ \text{C.} \quad \text{(A)}$$

$$240^\circ\ \text{C.} \leqq \text{FBP} \leqq 270^\circ\ \text{C.} \quad \text{(B)}$$

$$150^\circ\ \text{C.} \leqq \text{IBP(initial distillation point)} \leqq 165^\circ\ \text{C.} \quad \text{(C)}$$

Preferably, the kerosene composition comprises a C8-12 paraffin mixture of C8-12 n-paraffins and C8-12 iso-paraffins, and C13-16 iso-paraffins.

Preferably, in the kerosene composition the ratio of the C8-12 paraffin mixture containing C8-12 n-paraffins and C8-12 iso-paraffins, to the C13-16 iso-paraffins, as proportions by weight, is from 80:20 to 40:60, more preferably 70:30 to 50:50.

Most preferably, in the kerosene composition, the n-paraffins and/or iso-paraffins have been obtained by means of Fischer-Tropsch synthesis.

The present invention will be described in more detail below.

The kerosene compositions of the present invention can be obtained by taking synthesis gas obtained by the partial oxidation, steam reforming, etc. of natural gas or coal, for example, forming a long chain alkyl hydrocarbon polymer oil by means of a Fischer-Tropsch reaction and then carrying out hydrocracking and distillation to prepare a material with the prescribed properties. Furthermore, they can be obtained by cracking or synthesis, for example, from the various fractions which are obtained in petroleum refining.

Kerosene compositions are mixtures of various types of compound, and it is very difficult to predict general properties from a simple distillation curve or the properties of the individual compounds but, as a result of thorough research, it has been found that the aims can be achieved by ensuring that the properties of a kerosene composition, which has n-paraffins and iso-paraffins as the main components and which has an excellent extinguishing time and amount of heat generated, satisfy the aforementioned conditions (A) to (C).

If, in the present invention, the component containing n-paraffins and iso-paraffins is less than 99% by weight of the whole, then an aromatic component, an olefinic component or an oxygen-containing component, for example, is present and, depending on the particular case, components such as nitrogen components and sulfur components are present, and there may be a sensation of smell when the kerosene is being handled, when it is ignited and when it is extinguished, and the storage stability may become similar to that of general kerosene.

The aforementioned conditions (A) to (C) are essential for providing a kerosene composition with excellent heating performance and a short extinguishing time. By including a "heavy fraction" and especially C13-16 iso-paraffins, which satisfy the specifications (A) to (C), the evaporation of a low boiling point fraction is suppressed and it also has the effect of shortening the extinguishing time. On the other hand, if there is too much "heavy fraction", then the surface tension increases above the requirement and the fuel is taken up by the stove wick only with difficulty and there is likely to be reduction in heating capacity. Moreover, with n-paraffins and iso-paraffins accounting for at least 99% by weight of the whole of the kerosene composition, there is no unpleasant smell due to an aromatic component, for example, the exhaust gas is clean, and it also has the effect of providing good storage stability.

Furthermore, the extinguishing time is even shorter if material with an FBP (end point) of 250° C. or above is used.

If in the present invention the number of carbon atoms of the paraffins is 7 or less then the flash point is too low and it is possible that the specification for flash point of at least 40° C. for kerosene as laid down in JIS K 2203 will not be met, and if the number of carbon atoms of the n-paraffins exceeds 12 then the low temperature fluidity becomes poor and this is undesirable. Moreover, if the number of carbon atoms of the iso-paraffins exceeds 16 then it is possible that the requirement that the 95% distillation point is not more than 270° C. laid down in JIS K2203 will not be met and this is undesirable. Moreover, if the proportion of the C8-12 carbon atom paraffin mixture is too great then the extinguishing time is longer and an excess of fuel is supplied in a wick-type stove and the amount of heat generated is increased and this in undesirable on safety grounds. Furthermore, if there is too much C13-16 iso-paraffin then, conversely, the supply of fuel in a wick-type stove is inadequate, the amount of heat which is generated is reduced and satisfactory heating performance is not obtained.

Moreover, the C8-12 n-paraffins and the C8-12 iso-paraffins in the present invention can be constituted with an optional mixing ratio. This is because, provided that they are paraffins which have a number of carbon atoms within this range, in the present invention both the normal and iso-paraffins can be regarded as having roughly the same properties.

If the n-paraffin content exceeds 80%, it meets the JIS specification but the extinguishing time becomes a little longer than that of a commercial kerosene and this is undesirable. Moreover, the fuel supply in a wick-type stove becomes excessive, the amount of heat generated is increased and this is undesirable on safety grounds.

Examples of the n-paraffins which can be used in the present invention include n-nonane, n-decane, n-undecane, n-dodecane, and mixtures thereof, and examples of the iso-paraffins which can be used include n-methylundecane, 2,2-dimethylundecane, 2-methyldodecane, 2,2-dimethyldodecane, 2-methyltridecane, 2,2-dimethyltridecane, 2-methyltetradecane, and mixtures thereof.

The kerosene compositions of the present invention have the properties (1) to (4) indicated below, and they have a high smoke point and excellent combustion properties. If the smoke point is high and the combustion properties are improved, the time taken to achieve complete combustion after ignition is shortened and complete combustion is promoted at the time of normal combustion. Consequently there is no unpleasant smell or soot on ignition and the exhaust gas during ignition and during normal combustion is also clean.

(1) Flash Point: At least 40° C.

(2) Sulfur content: Not more than 10 ppb (3) Smoke point: At least 30 mm (values above 35 mm and even above 40 mm can be obtained)

(4) Density at 15° C.: Not more than 0.77 g/m3

Provided that the extinguishing time according to JIS S3031 is less than 125 seconds the extinguishing time is shorter than that of a commercial kerosene and the kerosene composition has a very high level of safety. Furthermore, if the pour point is adjusted to not more than −50° C. then it can be handled easily even in cold regions in winter.

The present invention will now be described in more detail by reference to the following illustrative examples which are meant to further illustrate the invention without limiting its scope: Examples 1 and 2, Comparative Examples 1 to 3, Reference Example 1.

n-Paraffin/iso-paraffin mixed oils of the compositions shown in Table 1 were obtained by production with SMDS (Shell Middle Distillate Synthesis) where natural gas is partially oxidized and heavy paraffins are synthesized by means of a Fischer-Tropsch synthesis and the heavy paraffin oil obtained is subjected to hydrocracking and distillation, and naphtha, kerosene and light oil fractions are obtained.

The properties of the kerosene compositions of Examples 1 and 2 and Comparative Examples 1 to 3 produced by means of the SMDS process as described above and of a general commercial JIS No.1 kerosene (Reference Example 1) are shown in Table 1.

TABLE 1

| | Test Method | Comp. Ex. 1 | Example 1 | Example 2 | Comp. Ex. 2 | Ref. Ex. 1 | Comp. Ex 3* |
|---|---|---|---|---|---|---|---|
| C8-12 n- and iso-paraffins | | 100 | 71 | 52 | 34 | — | — |
| C13-16 iso-paraffins | | 0 | 29 | 48 | 66 | — | — |
| Commercial kerosene | | 0 | 0 | 0 | 0 | 100 | 0 |
| Density (g/cm3) | JIS K2249 | 0.735 | 0.754 | 0.766 | 0.779 | 0.802 | 0.751 |
| Dynamic viscosity (mm2/s (30° C.)) | JIS K2283 | 1.07 | 1.34 | 1.60 | 2.05 | 1.63 | 1.25 |

TABLE 1-continued

| | Test Method | Comp. Ex. 1 | Example 1 | Example 2 | Comp. Ex. 2 | Ref. Ex. 1 | Comp. Ex 3* |
|---|---|---|---|---|---|---|---|
| Flash point (° C.) (TAG) | JIS K2265 | 41 | 47 | 49 | — | 49 | 45 |
| Flash point (° C.) (PMCC) | JIS K2265 | — | — | — | 61 | — | |
| Smoke point (mm) | JIS K2537 | >30 | >30 | >30 | >30 | 25 | >50 |
| Distillation (° C.) | JIS K2254 | | | | | | |
| IBP | | 156.5 | 160.5 | 163.0 | 169.5 | 153.0 | 166.0 |
| 5% | | 162.0 | 167.0 | 171.5 | 181.0 | 170.0 | 174.0 |
| 10% | | 163.0 | 168.5 | 174.5 | 186.0 | 176.0 | 176.0 |
| 20% | | 164.5 | 171.5 | 179.5 | 193.0 | 184.5 | 181.0 |
| 30% | | 166.5 | 174.5 | 184.0 | 200.5 | 192.5 | 186.0 |
| 40% | | 168.5 | 179.5 | 190.5 | 209.0 | 199.5 | 192.0 |
| 50% | | 171.0 | 184.0 | 198.5 | 217.5 | 208.5 | 197.0 |
| 60% | | 174.0 | 190.5 | 208.5 | 226.0 | 217.5 | 201.0 |
| 70% | | 178.0 | 200.0 | 220.5 | 234.0 | 228.5 | 204.7 |
| 80% | | 183.0 | 213.5 | 233.0 | 241.0 | 240.5 | 210.0 |
| 90% | | 189.5 | 234.5 | 244.5 | 248.0 | 254.5 | 218.0 |
| 95% | | 195.0 | 245.5 | 250.0 | 252.0 | 264.0 | 223.0 |
| FBP | | 207.5 | 253.5 | 256.0 | 258.0 | 273.5 | 236.0 |
| Pour point (° C.) | JIS K2269 | <−50 | <−50 | <−50 | <−50 | <−50 | −30 |
| Blockage point (° C.) | JIS K2288 | <−35 | <−35 | <−35 | <−35 | <−35 | <−35 |

*Corresponding to Example 5 of JP-A-63-150380

The tests indicated below were carried out using the kerosene of the Examples, Comparative Examples and the Reference Example.

Stove Combustion Test

The extinguishing time (JIS S3031), the amount of heat generated (aircraft fuel oil A method, JIS K2279) and the fuel consumption were measured using a wick type convection stove (Model SL-221, manufactured by Moto Corona).

Method of Evaluating Combustion Performance (1) Extinguishing Time (Normal Ignition)

Measurement of the extinguishing time was carried out in accordance with JIS S3031. The fuel for evaluation was burned for 1 hour with the wick in the uppermost position and then the time taken for the flame to be extinguished completely on visual observation when the wick was lowered was taken to be the extinguishing time. Evaluation of the extinguishing time was carried out twice for each fuel. Moreover, the tests were carried out in a dark room so that the flame could be seen distinctly.

The evaluation was carried out following the procedure indicated below.

(a) The fuel, which was to be evaluated, was introduced into an empty stove accessory tank and the fuel, which had been left inside the stove, was removed with a syringe.

(b) The tank containing the fuel, which was to be evaluated, was set in the stove.

(c) The fuel was burned for 1 hour with the wick in the uppermost position.

(d) After burning for 1 hour, the wick was turned down in one movement and extinguished.

(e) The time from when the wick had been turned right down until the flame was seen visually to be completely extinguished was measured using a stopwatch and recorded.

(f) The stove was re-lit and, after burning for 15 minutes, the extinguishing time was measured a second time.

The results obtained are shown in Table 2.

(2) Fuel Consumption Test

This was carried out in the way summarized below.

(a) After removing any fuel remaining in the stove, the fuel, which was to be evaluated, was introduced.

(b) The stove as a whole was weighed.

(c) After burning the fuel which was to be evaluated for 7 hours at the maximum combustion for each stove, the stove was extinguished.

(d) After being extinguished, the whole of the stove was weighed and the weight was recorded and the fuel consumption was obtained from the difference between the weight before the test and the weight after the test.

The results obtained are shown in Table 3.

TABLE 2

| | | Comp. Ex. 1 | Example 1 | Example 2 | Comp. Ex. 2 | Ref. Ex. 1 | Comp. Ex 3 |
|---|---|---|---|---|---|---|---|
| First Measurement (seconds) | JIS S3031 | 150 | 88 | 71 | 66 | 137 | 145 |
| Second measurement (seconds) | JIS S3031 | 153 | 80 | 78 | 58 | 116 | 135 |
| Average (seconds) | JIS S3031 | 152 | 84 | 75 | 62 | 127 | 140 |

TABLE 3

| | | Comp. Ex. 1 | Example 1 | Example 2 | Comp. Ex. 2 | Ref. Ex. 1 | Comp. Ex 3 |
|---|---|---|---|---|---|---|---|
| Measured fuel consumption (L/h) | | 0.495 | 0.446 | 0.424 | 0.377 | 0.407 | 0.466 |
| Amount of heat generated per unit volume (MJ/L) | JIS K2279 | 32.5 | 33.3 | 33.7 | 34.2 | 34.7 | 32.9 |
| Amount of heat generated per unit time (MJ/h) | — | 16.1 | 14.9 | 14.3 | 12.9 | 14.1 | 15.3 |
| Difference in the amount of heat generated per hour with respect to the commercial kerosene (%) | — | 14 | 6 | 1 | −9 | 0 | 9 |

As is clear from the Tables, the properties of the kerosene compositions of the present invention are excellent with a high smoke point of at least 30 mm, a short extinguishing time and an excellent heating capacity (amount of heat generated).

What is claimed is:

1. A kerosene composition comprising:

in relation to the total composition, at least 99% by weight of n-paraffins and iso-paraffins comprising a C8-12 paraffin mixture of C8-12 n-paraffins and C8-12 iso-paraffins, and an amount of C13-16 iso-paraffins effective to produce an extinguishing time according to JIS S 3031 of less than 125 seconds without substantially reducing heating capacity;

wherein the kerosene composition has the properties indicated by the following formulae:

$$6.0° \text{ C.} \leqq FBP(\text{end point}) - 95\% \text{ distillation point} \leqq 11.0° \text{ C.}; \quad (A)$$

$$240° \text{ C.} \leqq \text{FBP} \leqq 270° \text{ C.; and,} \quad (B)$$

$$150° \text{ C.} \leqq \text{IBP(initial distillation point)} \leqq 165° \text{ C.} \quad (C)$$

2. The kerosene composition of claim 1 wherein the pour point is no more than −50° C.

3. The kerosene composition of claim 1 wherein the FBP (end point) is 250° C. or above.

4. The kerosene composition of claim 1 wherein the n-paraffins are selected from the group consisting of n-nonane, n-decane, n-undecane, n-dodecane, and mixtures thereof.

5. The kerosene composition of claim 1 wherein the iso-paraffins are selected from the group consisting of n-methylundecane, 2,2-dimethylundecane, 2-methyldodecane, 2,2-dimethyldodecane, 2-methyltridecane, 2,2-dimethyltridecane, 2-methyltetradecane, and mixtures thereof.

6. The kerosene composition of claim 1 wherein the n-paraffins and/or iso-paraffins have been obtained by Fischer-Tropsch synthesis.

7. A kerosene composition comprising:

in relation to the total composition, at least 99% by weight of n-paraffins and iso-paraffins comprising C8-12 n-paraffins, C8-12 iso-paraffins, and C 13-16 iso-paraffins;

wherein the weight ratio of the C8-12 iso-paraffins and C8-12 iso-paraffins to the C13-16 iso-paraffins is from 80:20 to 40:60;

wherein the kerosene composition has the properties indicated by the following formulae:

$$6.0° \text{ C.} \leqq FBP(\text{end point}) - 95\% \text{ distillation point} \leqq 11.0° \text{ C.}; \quad (A)$$

$$240° \text{ C.} \leqq \text{FBP} \leqq 270° \text{ C.; and,} \quad (B)$$

$$150° \text{ C.} \leqq \text{IBP(initial distillation point)} \leqq 165° \text{ C.} \quad (C)$$

8. The kerosene composition of claim 7 wherein the weight ratio of the C8-12 paraffins and C8-12 iso-paraffins to the C 13-16 iso-paraffins is from 70:30 to 50:50.

9. The kerosene composition of claim 7 wherein the pour point is no more than −50° C.

10. The kerosene composition of claim 9 wherein the FBP (end point) is 250° C. or above.

11. The kerosene composition of claim 10 wherein the n-paraffins are selected from the group consisting of n-nonane, n-decane, n-undecane, n-dodecane, and mixtures thereof.

12. The kerosene composition of claim 10 wherein the iso-paraffins are selected from the group consisting of n-methylundecane, 2,2-dimethylundecane, 2-methyldodecane, 2,2-dimethyldodecane, 2-methyltridecane, 2,2-dimethyltridecane, 2-methyltetradecane, and mixtures thereof.

13. The kerosene composition of claim 9 wherein the n-paraffins are selected from the group consisting of n-nonane, n-decane, n-undecane, n-dodecane, and mixtures thereof.

14. The kerosene composition of claim 13 wherein the iso-paraffins are selected from the group consisting of n-methylundecane, 2,2-dimethylundecane, 2-methyldodecane, 2,2-dimethyldodecane, 2-methyltridecane, 2,2-dimethyltridecane, 2-methyltetradecane, and mixtures thereof.

15. The kerosene composition of claim 9 wherein the iso-paraffins are selected from the group consisting of n-methylundecane, 2,2-dimethylundecane, 2-methyldodecane, 2,2-dimethyldodecane, 2-methyltridecane, 2,2-dimethyltridecane, 2-methyltetradecane, and mixtures thereof.

16. The kerosene composition of claim 7 wherein the FBP (end point) is 250° C. or above.

17. The kerosene composition of claim 7 wherein the n-paraffins are selected from the group consisting of n-nonane, n-decane, n-undecane, n-dodecane, and mixtures thereof.

18. The kerosene composition of claim 7 wherein the iso-paraffins are selected from the group consisting of n-methylundecane, 2,2-dimethylundecane, 2-methyldodecane, 2,2-dimethyldodecane, 2-methyltridecane, 2,2-dimethyltridecane, 2-methyltetradecane, and mixtures thereof.

19. The kerosene composition of claim 7 wherein the n-paraffins and/or iso-paraffins have been obtained by Fischer-Tropsch synthesis.

* * * * *